United States Patent [19]

Clark et al.

[11] 4,129,527

[45] Dec. 12, 1978

[54] LIQUID ABRASIVE DETERGENT COMPOSITION AND METHOD FOR PREPARING SAME

[75] Inventors: Frederick P. Clark, Walnut Creek; Robert C. Johnson, Pleasanton, both of Calif.; John Topolewski, Overland Park, Kans.

[73] Assignee: The Clorox Company, Oakland, Calif.

[21] Appl. No.: 697,961

[22] Filed: Jun. 21, 1976

Related U.S. Application Data

[63] Continuation of Ser. No. 521,557, Nov. 7, 1974, abandoned.

[51] Int. Cl.[2] ..... C11D 1/17; C11D 1/83

[52] U.S. Cl. ..... 252/547; 252/528; 252/558; 252/DIG. 14

[58] Field of Search ..... 252/140, 528, 547, DIG. 14, 252/89, 558, 89 R

[56] References Cited

U.S. PATENT DOCUMENTS

| | | | |
|---|---|---|---|
| 3,149,078 | 9/1964 | Zmoda | 252/99 X |
| 3,522,186 | 7/1970 | Cambre | 252/112 |
| 3,630,922 | 12/1971 | McClain et al. | 252/99 |
| 3,677,954 | 7/1972 | Nakajima et al. | 252/121 |
| 3,700,607 | 10/1972 | Sundby et al. | 252/528 |
| 3,733,280 | 5/1973 | Chakrabarti et al. | 252/528 X |
| 3,843,563 | 10/1974 | Daires et al. | 252/528 X |
| 3,928,249 | 12/1975 | Nunziata et al. | 252/547 X |
| 3,943,234 | 3/1976 | Roggenkamp | 252/DIG. 14 |
| 3,959,155 | 5/1976 | Montgomery et al. | 252/547 X |

*Primary Examiner*—Thomas J. Herbert, Jr.
*Attorney, Agent, or Firm*—Phillips, Moore, Weissenberger, Lempio & Majestic

[57] ABSTRACT

A pourable detergent composition is provided, with an abrasive material suspended therein. The suspension remains stable over long periods of time. The composition includes a finely divided water-insoluble abrasive material, and a suspension medium comprising water, an amine oxide surfactant, a multiple ionic-oxygen containing salt, and a salt of an alkylaryl sulfonate, all admixed in the water to achieve stable suspension of the abrasive material. All the ingredients are mixed in a particular sequence to achieve uniformity in suspension ability.

9 Claims, No Drawings

LIQUID ABRASIVE DETERGENT COMPOSITION AND METHOD FOR PREPARING SAME

This is a continuation of Serial No. 521,557, filed Nov. 7, 1974, now abandoned.

BACKGROUND OF THE INVENTION

Abrasive cleaners have long been utilized as a household product. These compositions possess a physical "cutting" action that is most advantageous in removing stubborn stains and dirt deposits from fixtures, floors, appliances, etc. Almost universally, however, such cleanser compositions are marketed in the dry, powdered form. In such form, the compositions are somewhat difficult to apply to some surfaces, especially vertical surfaces; and, in addition, tend to cake and lump if accidentally moistened, thus interfering with the pouring and application thereof. Further, such cleansers most usually employ abrasives of a relatively high hardness, whereby their cleansing action is quite severe. They find their greatest use, therefore, in the most difficult cleansing situations.

On the other hand, there are large numbers of cleaning compositions, usually liquids, detergent and surfactant based, that are useful in normal light or easy soil removing operations. These compositions lack an abrasive component and are therefore relatively poor in removing stains and tightly adhering particles or dirt. Such compositions fall into the "light duty" category of cleaning compositions.

It is clear that both aforementioned types of cleaners suffer deficiencies, i.e., difficulty of application to some surfaces and harsh action in the case of abrasive cleaners, and "light duty" cleaning efficiency in the cases of liquid detergents.

It is therefore apparent that a liquid abrasive detergent composition would provide a useful intermediate range of cleaning compositions. Such a composition should provide relative ease of application, but yet have strong cleanser properties akin to those of the abrasive cleanser category.

There have been some prior attempts to produce such liquid abrasive compositions. But the principal road block to success is the difficult problem of achieving a stable suspension of the abrasive in the liquid medium. Since abrasive materials must not dissolve in the suspension medium in order to retain their "cutting action", they remain in the particulate state; at the same time, these abrasive particles are universally heavier, on a mass per unit volume basis, than the liquid suspension medium, whereby the particles tend to settle to the bottom of the container unless the suspending force of the medium is greater than the gravitational force on the particles. Attempts have been made to achieve liquid or pourable abrasive suspensions with suitable detergent capabilities; some success has been noted in the literature, for instance, U.S. Pat. No. 3,281,367. Other prior patents, such as U.S. Pat. Nos. 3,149,078; 3,210,285; 3,210,286; 3,214,380; 3,522,186; 3,630,922; and 3,677,954 deal with detergent compositions or components therefor having general applicability to the present invention. The publication in "Soap and Sanitary Chemicals", February 1951, page 41 by Sanders and Knaggs discusses "High Viscosity Detergent Solutions" of further interest in the present invention.

However, despite the referred to previous works, a fully stable liquid abrasive detergent composition appears to have eluded prior workers.

BRIEF DESCRIPTION OF THE INVENTION

The present invention is directed to compositions that are stable suspensions of pourable abrasive-detergents and to a method for producing said stable compositions.

More specifically, the compositions are comprised of abrasive material suspended in an aqueous vehicle having three essential suspension components—an amine oxide surfactant, a multiple ionic-oxide containing salt, and an alkylaryl sulfonate salt. Coloring agents and perfumes may also be present, but they are not necessary for either suspension stability or detergency of the compositions. All three of the suspension components are necessary to achieve a stable suspension of the abrasive ingredient.

The preferred compositions utilize an amine oxide, an alkylaryl sulfonate, and a soluble citrate salt, e.g., potassium citrate, as the suspending agents.

It is further important to prepare the pourable abrasive-detergent composition in a particular sequence of operations to yield a stable product of uniform quality. This sequence of preparation steps will be discussed fully herein below.

It is an object of the invention to provide an abrasive-detergent composition wherein the abrasive is suspended within the detergent vehicle.

It is another object of the invention to provide a pourable abrasive-detergent composition.

It is a further object of the invention to provide a method for preparing a stable suspension of an abrasive in an aqueous liquid detergent vehicle.

Other objects and advantages of the invention will be apparent from the following description and the clains appended hereto.

DETAILED DESCRIPTION OF THE INVENTION

The compositions of the invention are stable, pourable suspensions of abrasive particles in an aqueous detergent vehicle.

It has been found that such stable suspensions are most difficult to prepare unless certain key suspension agents are present in the composition. Specifically these key suspension agents are: in amine oxide surfactant, a multiple-ionic oxygen containing salt, and an alkylbenzenesulfonate salt.

These suspension agents along with water produce a suspension vehicle that is fully capable of suspending abrasive particles for an indefinite period of time. Thus the product has a long "shelf-life" and there is no necessity for agitating the composition before use to ensure complete distribution of the abrasive throughout the composition. In addition the composition is "pourable" and may be squirted or forced through small orifices for easy application to vertical or overhead surfaces.

It has also been noted that it is possible to add abrasive to the suspension vehicle in increasing amounts without "breaking" the suspension. However eventually the composition's viscosity increases (at about 700 parts/1000 abrasive) to a point where it is no longer possible to pour the same. Thus it is ordinarily desirable to hold abrasive levels down to a point where it is easy to apply the composition and it is relatively liquid, or of the consistancy of a heavy cream. In a preferred composition, the abrasive is present in about 500 parts by weight, lauryl dimethyl amine oxide is present in about 20 parts by weight, the citrate salt is present in about 10–20 parts by weight, and sodium alkylaryl sulfonate is present in about 30 parts by weight, in water sufficient to make up a total of 1000 parts of the composition.

While the abrasive may be varied over a wide range as pointed out above, each of the suspension agents must be present within defined limits in order to produce a stable composition. In this regard, when the potassium citrate salt, the abrasive, and the sulfonate are held at their preferred levels, the lauryl dimethyl amine oxide concentration may be varied from about 12 parts/1000 of composition up to about 40 parts/1000 without destroying the suspension capabilities. However, maximum suspension capabilities appear at about 36 parts amine oxide/1000 parts of composition.

When the abrasive, potassium citrate salt and the lauryl dimethyl amine oxide are held at their preferred levels, the sulfonate detergent may be varied from about 16.5 parts/1000 of composition up to a sufficient concentration to increase composition viscosity to the "pour-point". Generally, however, sulfonate concentrations beyond 100 parts/1000 are uneconomical.

When the abrasive, sulfonate detergent, and amine oxide are held at their preferred levels, the potassium citrate salt may be varied from about 2 parts/1000 up to about 30 parts/1000 without seriously impairing the suspension abilities. Maximum suspension capabilities are realized at a concentration of about 10 parts/1000 of composition.

The amine oxide is an essential component of the composition. The preferred amine oxides are of the type:

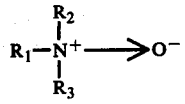

Where $R_1$ is an aliphatic carbon chain and $R_2$ and $R_3$ are methyl groups. One specific preferred amine oxide is lauryl dimethyl amine oxide, available commercially from the Onyx Chemical Co.

The alkylbenzenesulfonate (LAS), also an essential component of the composition, is of the general formula:

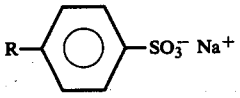

Where R is an aliphatic carbon chain mixture of from 8 to 18 carbon atoms. Preferably, the 10, 11 12, 13 and 14 carbon atom chains predominate in the mixture. Such a material is commercially available from the Pilot Chemical Company.

The oxygen containing salt is also a necessary component in the composition. The preferred salt is potassium citrate, which yields a non-phosphate product with the necessary suspension and detergency properties. Other salts exhibiting similar properties are such salts as: tetrapotassium pyrophosphate, sodium gluconate, potassium sodium tartrate, potassium sulfate, potassium carbonate, sodium acetate, tetrasodium ethylenediamine-tetraacetate, and sodium citrate. Any of the above-named salts can be utilized in place of potassium citrate at the level of 2%, by weight.

All of the above-noted salts are characterized by multiple ionic-oxygen atoms in the molecule. Tests have shown that mono-ionic-oxygen containing salts, e.g., sodium bicarbonate, do yield suspensions under moderate temperature storage conditions. However, under elevated temperatures, e.g. 140° F., such suspensions breakdown. Salts with no oxygen atoms, e.g. sodium chloride do not yield stable suspensions even under storage at room temperature.

The abrasive material is generally a matter of choice between the well-known insoluble materials utilized for these purposes. e.g. silica, calcium carbonate, zirconium oxide etc. It is preferred, however, to use rather "soft" abrasive with Mohs hardness of less than about 4, in the invention compositions. Calcite, i.e., calcium carbonate serves this purpose quite well.

Particle size of the abrasive should be such that at least 99% passes through a 100 mesh screen but not so fine as to unduly thicken the mixture. The abrasive can be present in the composition in from only minute amounts up to a concentration where the composition is no longer pourable. Generally, abrasive concentrations above 700 parts/1000 are impractical. The partical size may vary from that noted above and will vary in accordance with the particular abrasive material utilized in the composition. The acceptable particle size is affected by the density of the abrasive and concentration of the suspension agents in the aqueous suspension medium.

While it is necessary to employ all of the above-noted suspension agents in order to achieve a stable product, it has been found that it is also important to mix the various ingredients in the proper sequence in order to produce a product of uniform quality from batch to batch. If the mixing sequence disclosed below is not followed, successive batches mixed in the same vessel will be of varying rheological properties and reduced suspending capability. In commercial production it is desirable to mix successive batches in the same vessel without resort to extensive cleaning operations between batches. If the mixing sequence noted below is not followed, the successive batches, for undetermined reasons, exhibit successively lower viscosities and reduced suspending ability. If the mixing order described below is followed, then successive batches mixed in the same vessel will produce products of uniform viscosity and stability.

The ingredients should be mixed in the following manner:

The desired quantity of water is charged into a suitable mixing vessel. The entire amount of dry abrasive particles is then mixed into the water with moderate stirring to keep the abrasive well distributed throughout the water. The addition of abrasive to the water with continued stirring also permits occluded air to escape from the vessel.

The amine oxide (obtainable as a 30% aqueous solution) is then added to the abrasive-water mixture with continued stirring but not so vigorously as to entrap air into the mixture. After addition of the amine oxide the multiple ionic-oxygen containing salt is then added with continued stirring.

Finally the LAS is added into the vessel containing the previously mentioned components. The LAS may be added as solid flake; however, most preferably the LAS flake is normally predissolved in water to allow the aqueous LAS solution to de-aerate before mixing with the product. LASmmay also be used as an aqueous solution, as received from the manufacturer. The presence of hydrotropes must be avoided as they destroy the suspending properties of the mixture.

After addition of the LAS, small amounts of perfume and/or colorants may be added in order to enhance the aesthetic properties of the product. No heat or pressure is necessary in the mixing process but agitation must be controlled to avoid high shear which may degrade the end product stability.

After final mixing of all the ingredients the product may then be drawn off from the mixing vessel into suitable containers for storage and subsequent shipment.

The product produced from the ingredients described above and in accordance with the above procedure has a slightly grayish-white, rather "chalky" appearance. The product is the consistency of a "heavy cream" but is easily pourable with a consistency thick enough to cling to vertical surfaces. The product may also be stored for many months without exhibiting any appreciable separation or settling out of the abrasive material. The product of the invention further exhibits the aforesaid stability even when stored at moderately high temperatures, e.g. 140° F.

Storage stability test performed onthe preferred composition have shown that, after storage in a close glass container, with little or no headspace, for as much as (a) 11 months at 70° F., (b) 6 months at 100° F. followed by 5 months at 70° F. (c) 3 months at 140° F. followed by 8 months at 70° F. and (d) 3 successive freezings and thawings, followed by 11 months at 70° F., the composition exhibits no serum formation nor settling of the abrasive material.

The product finds utility as a cleaning composition especially useful for kitchen and bathroom surfaces and may even by applied to fiberglass surfaces if gently wiped therefrom. However, since the abrasive normally utilized in the composition, i.e., calcite is relatively soft, the cleaner may be applied to many types of surface without damage thereto.

What is claimed is:

1. A stable liquid suspension of abrasive particles in an aqueous detergent vehicle, consisting essentially of abrasive particles wherein said abrasive particles are less than 100 mesh size but of sufficient size so as to provide gentle abrasive action suspended in a solution of water and suspension agents consisting essentially of lauryl dimethyl amine oxide, a multiple ionic oxygen containing salt, and an alkylaryl sulfonate detergent, said abrasive particles comprising in the order of about 500 parts by weight per 1,000 parts of the suspension.

2. The stable suspension of claim 1 wherein said abrasive particles are calcite.

3. The suspension of claim 1 wherein the lauryl dimethyl amine oxide is present in from about 12 parts by weight per 1000 parts of the suspension to about 40 parts by weight per 1000 of suspension.

4. The suspension of claim 1 wherein said multiple ionic-oxygen containing salt is selected from the group consisting of potassium citrate, tetrapotassium pyrophosphate, sodium gluconate, potassium sodium tartrate, potassium sulfate, potassium carbonate, sodium acetate, tetrasodium ethylenediamine acetate, and sodium citrate.

5. The suspension of claim 4 wherein the multiple ionic oxygen containing salt is a citrate salt present, by weight, in the amount of from about 2 parts per 1000 to 30 parts per 1000 parts of the suspension.

6. The suspension of claim 5 wherein the citrate salt is present in an amount of about 20 parts per 1000 parts of suspension.

7. The suspension of claim 1 wherein the alkylaryl sulfonate is of the formula:

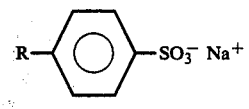

wherein R is an 8 to 18 carbon atom aliphatic chain mixture.

8. The suspension of claim 7 wherein the alkylaryl sulfonate is present, by weight, in an amount at least 16.5 parts per 1000 parts of the suspension.

9. A stable liquid suspension of abrasive particles of an aqueous detergent vehicle consisting essentially of:

abrasive particles wherein said abrasive particles are less than 100 mesh size but of sufficient size as to provide gentle abrasive action suspended in a solution of water and suspension agents, said suspension agents consisting essentially of:

lauryl dimethyl amine oxide in an amount of from about 12 parts by weight per thousand parts of suspension to about 40 parts by weight per thousand of suspension;

a multiple ionic oxygen containing salt in an amount of from about two parts per thousand parts of the suspension to about thirty parts per thousand part of the suspension; and an alkylaryl sulfonate detergent, present by weight in an amount of at least 16.5 parts per thousand parts of the suspension, said abrasive particles comprising in the order of about 500 parts by weight per 1000 parts of the suspension.

* * * * *

UNITED STATES PATENT OFFICE

CERTIFICATE OF CORRECTION

Patent No. 4,129,527 Dated December 12, 1978

Inventor(s) Frederick P. Clark, Et.Al.

It is certified that error appears in the above-identified patent and that said Letters Patent are hereby corrected as shown below:

Column 2, line 33 change "clains" to --claims--

Column 3, line 51 insert --,-- between numbers 11 12

Column 4, line 65 change "LASmmay" to --LAS may--

Column 5, line 21 change "onthe" to --on the--

Signed and Sealed this

*Twentieth* Day of *March 1979*

[SEAL]

*Attest:*

RUTH C. MASON
*Attesting Officer*

DONALD W. BANNER
*Commissioner of Patents and Trademarks*